US012391440B2

(12) United States Patent
Engstrom et al.

(10) Patent No.: US 12,391,440 B2
(45) Date of Patent: Aug. 19, 2025

(54) SYSTEM AND METHOD FOR DISPENSING FLUID

(71) Applicant: Nexa3D Inc., Ventura, CA (US)

(72) Inventors: Connor Paul Engstrom, Ventura, CA (US); Francis Kenyon Whetsell, Ventura, CA (US)

(73) Assignee: STRATASYS, INC., Minnetonka, MN (US)

( * ) Notice: Subject to any disclaimer, the term of this patent is extended or adjusted under 35 U.S.C. 154(b) by 154 days.

(21) Appl. No.: 18/215,092

(22) Filed: Jun. 27, 2023

(65) Prior Publication Data

US 2025/0002235 A1 Jan. 2, 2025

(51) Int. Cl.
*B65D 47/24* (2006.01)

(52) U.S. Cl.
CPC ..... *B65D 47/248* (2013.01); *B65D 2205/02* (2013.01); *B65D 2547/06* (2013.01)

(58) Field of Classification Search
CPC ..... B65D 47/245; B65D 47/248–249; B65D 2205/00; B67D 3/0032; F16K 31/58; F16K 2200/301
USPC ..... 137/587, 588; 251/320–323; 222/484; 215/309
See application file for complete search history.

(56) References Cited

U.S. PATENT DOCUMENTS 808,131 A * 12/1905 Wiesennfeld .... B60K 15/03519 137/170.4
1,207,505 A * 12/1916 Cordley ..... B67D 3/0029 137/614.19
1,494,043 A * 5/1924 Vogt ..... H01M 50/609 222/484
1,525,032 A * 2/1925 Grady ..... B65D 47/248 222/484
1,865,269 A * 6/1932 Munday ..... B65D 47/249 222/487
2,006,369 A * 7/1935 Sargent ..... B65D 47/248 222/542
2,197,352 A * 4/1940 Terkel ..... F16K 24/02 222/542
2,324,965 A * 7/1943 Turner ..... B67D 7/32 141/288
2,337,276 A 12/1943 Sanchis
2,440,112 A * 4/1948 Nellson ..... A47J 41/0027 222/484
2,445,130 A * 7/1948 Turner ..... B67D 3/043 141/308

(Continued)

*Primary Examiner* — Paul R Durand
(74) *Attorney, Agent, or Firm* — Faegre Drinker Biddle & Reath LLP

(57) ABSTRACT

A dispensing cap may include a cap body and a sealing assembly. The cap body may include a first opening, a second opening distinct from the first opening, and one or more guiding surfaces. The first opening may be configured to dispense a fluid (e.g., a liquid), and the second opening may be configured to pass a gas. The sealing assembly may be slidably attached to the one or more guiding surfaces of the cap body and may be translatable between a first position and a second position. In the first position, the sealing assembly seals the first opening and stops a flow of the gas through the second opening. In the second position, the sealing assembly does not seal the first opening and does not stop the flow of the gas through the second opening.

12 Claims, 12 Drawing Sheets

(56) References Cited

U.S. PATENT DOCUMENTS

| | | | | | |
|---|---|---|---|---|---|
| 2,808,178 | A * | 10/1957 | McIntyre | B67D 3/02 | 222/38 |
| 2,939,611 | A * | 6/1960 | Nebinger | B67D 3/00 | 222/481.5 |
| 2,963,205 | A | 12/1960 | Beall, Jr. | | |
| 3,005,475 | A | 10/1961 | Beall, Jr. | | |
| 3,204,832 | A | 9/1965 | Barber | | |
| 3,739,938 | A * | 6/1973 | Paz | B65D 47/248 | D7/510 |
| 4,509,655 | A * | 4/1985 | Killmann | B65D 39/08 | 222/484 |
| 4,664,297 | A * | 5/1987 | Giovinazzi | B67D 3/044 | 222/509 |
| 6,945,433 | B2 | 9/2005 | Laible | | |
| 8,684,026 | B2 | 4/2014 | Rundin | | |
| 10,315,910 | B2 * | 6/2019 | Boucher | B67D 7/54 | |
| 10,455,960 | B2 * | 10/2019 | Young | B65D 51/1683 | |
| 10,836,624 | B2 | 11/2020 | Eaton et al. | | |
| 2005/0254882 | A1 | 11/2005 | Hofte et al. | | |
| 2024/0336410 | A1 * | 10/2024 | Iwamura | B65D 47/249 | |

* cited by examiner

SYSTEM AND METHOD FOR DISPENSING FLUID

FIELD OF THE INVENTION

The present invention relates to a dispensing cap, and more specifically relates to a system and method that utilizes the dispensing cap for dispensing a fluid.

BACKGROUND

While many advancements have been made in the field of three-dimensional (3D) printing, there is still room for improvement on certain aspects including the fluid dispensing system that dispenses resin from a bottle into the tank of a 3D printing system.

SUMMARY OF THE INVENTION

In accordance with one embodiment of the invention, a dispensing cap may include a cap body and a sealing assembly. The cap body may include a first opening, a second opening distinct from the first opening, and one or more guiding surfaces. The first opening may be configured to dispense a fluid (e.g., a liquid), and the second opening may be configured to pass a gas. In one embodiment, the one or more guiding surfaces may be formed by one or more guide rods of the cap body.

The sealing assembly may be slidably attached to the one or more guiding surfaces of the cap body via ring members, and may be translatable between a first position and a second position. In the first (lowered) position, the sealing assembly seals the first opening and stops a flow of the gas through the second opening. In the second (elevated) position, the sealing assembly does not seal the first opening and does not stop the flow of the gas through the second opening.

Respective springs coiled about each of the guide rods may bias the sealing assembly toward the first opening. More specifically, the sealing assembly may include a plunger with sides affixed to the ring members of the sealing assembly, and the respective guide rods may be inserted through the ring members. The movement of the springs may be constrained between ridges (e.g., formed by washers) of the guide rods and the ring members of the sealing assembly. The position of the ridges may be fixed on the respective guide rods, so that the expansion of the springs causes the ring members to be translated downwards along the respective guide rods, thereby biasing the sealing assembly towards the first opening.

The dispensing cap may be secured to an opening of a bottle containing a fluid (e.g., photo-curing resin) to form a fluid container. Even if the fluid container is inverted (i.e., with the opening of the bottle pointing downwards), the fluid contained within the fluid container does not leak out of the fluid container, as the dispensing cap is designed to be sealed in the default mode of operation. To form a dispensing system, the fluid container may be inserted into a container receptacle until tabs of the container receptacle latch onto a projecting rim of the dispensing cap. At the same time as the fluid container is inserted into the container receptacle, a projecting portion of the container receptacle may displace the sealing assembly of the dispensing cap (e.g., in an upwards direction), allowing fluid from the bottle to flow out of the first opening of the cap body and gas to flow into the second opening of the cap body.

The dispensing system is self-regulating in that the fluid stops flowing from the fluid container when the fluid reaches a fill line of a tank disposed adjacent to (e.g., below) the dispensing system. More specifically, the flow of fluid from the fluid container (i.e., through the first opening of the cap body) may create a partial vacuum within the fluid container which partially impedes the flow of additional fluid from the fluid container into the tank. Intermittently, gas may flow into the fluid container (i.e., through the second opening of the cap body), reducing the partial vacuum within the fluid container and allowing additional fluid to flow into the tank. Eventually, when the fluid reaches a fill line of the tank, an equilibrium may be reached between the forces exerted on the fluid within the tank and the forces exerted on the fluid within the fluid container, causing the fluid to stop flowing from the fluid container into the tank. As fluid is consumed within the tank by printing operations, the top surface of fluid within the tank may intermittently decrease below the fill line, causing additional fluid from the fluid container to flow into the tank until the fluid reaches the fill line again.

These and other embodiments of the invention are more fully described in association with the drawings below.

BRIEF DESCRIPTION OF THE DRAWINGS

In FIG. 2D, the sealing assembly is disposed in the default (sealed or resting) position, whereas in FIG. 2E, the sealing assembly is disposed in an elevated (unsealed or retracted) position.

DETAILED DESCRIPTION OF THE INVENTION

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention. Descriptions associated with any one of the figures may be applied to different figures containing like or similar components/steps.

Figure 1C:
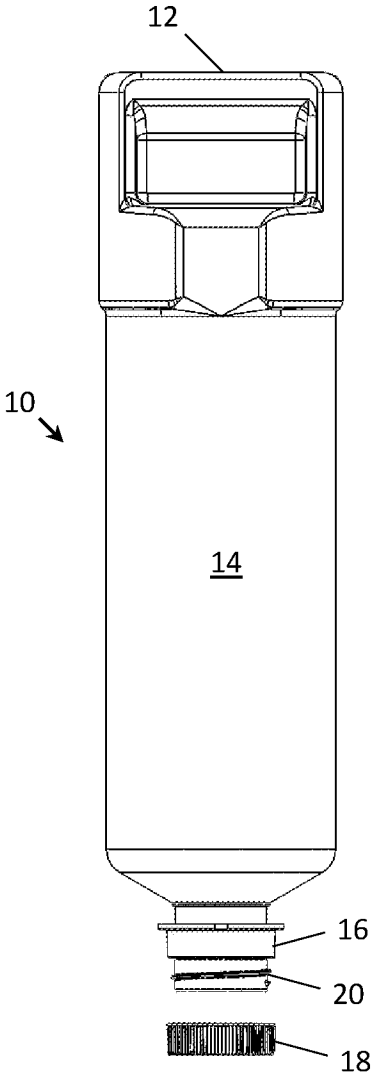
FIG. 1C depicts a side view of a fluid container in which the sealing cap has been unscrewed from the fluid container, in accordance with one embodiment of the invention.
Figure 1B:
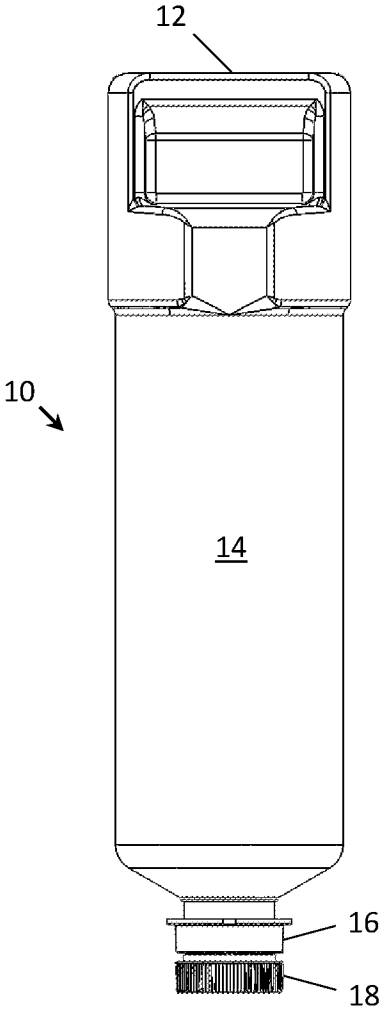
FIG. 1B depicts a side view of a fluid container in which the fluid container is sealed by the sealing cap, in accordance with one embodiment of the invention.
Figure 1A:
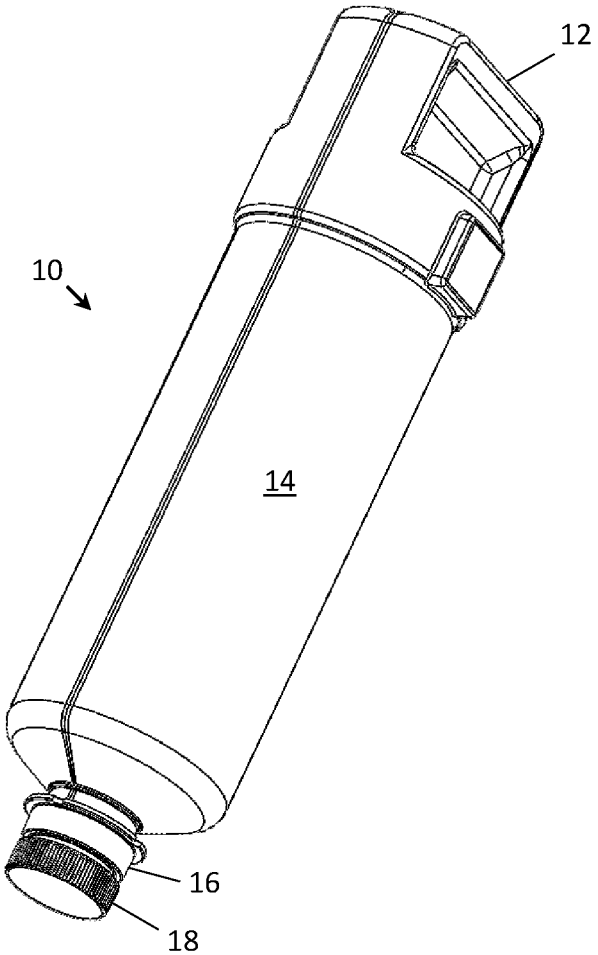
FIG. 1A depicts a perspective view of a fluid container in which the fluid container is sealed by a sealing cap, in accordance with one embodiment of the invention.

FIG. 1A depicts a perspective view of a fluid container 10 that is used to contain a fluid (e.g., photo-curable resin) for a 3D printing system (not shown). Additional details of the 3D printing system may be found in U.S. Pat. No. 11,498,275, which is incorporated by reference herein in its entirety. The fluid container 10 may include a bottle 14 and a dispensing cap 16 that are both responsible for forming a cavity 78 (see FIG. 5B) for containing a fluid. The structure of the dispensing cap 16 will be described in detail below in connection with FIGS. 2A-2F. The fluid container 10 may also include a handle 12 for a human operator to easily grasp the top portion of the fluid container 10 (e.g., allowing the human operator to carry the fluid container 10 from one location to another location). When the fluid container 10 is not inserted into a container receptacle 54 (see FIG. 4), the dispensing cap 16 alone may be sufficient to form an air-tight seal and seal the fluid within the fluid container 10. However, for added redundancy and to prevent accidental opening of the dispensing cap 16 when the fluid container 10 is being stored in a storage location or is being transported, a sealing cap 18 may be attached (e.g., screwed) onto an end of the dispensing cap 16, as shown in FIGS. 1A and 1B. For increased clarity, FIG. 1C depicts the sealing cap 18 detached (e.g., unscrewed) from the dispensing cap 16. While the sealing cap 18 may be secured to the dispensing cap 16 via a threaded coupling (which includes a threaded cylindrical outer surface 20 of the dispensing cap 16) as shown in FIG. 1C, it is understood that other forms of coupling may be employed, such as a friction fit coupling, a bayonet mount, etc.

Figure 2B:
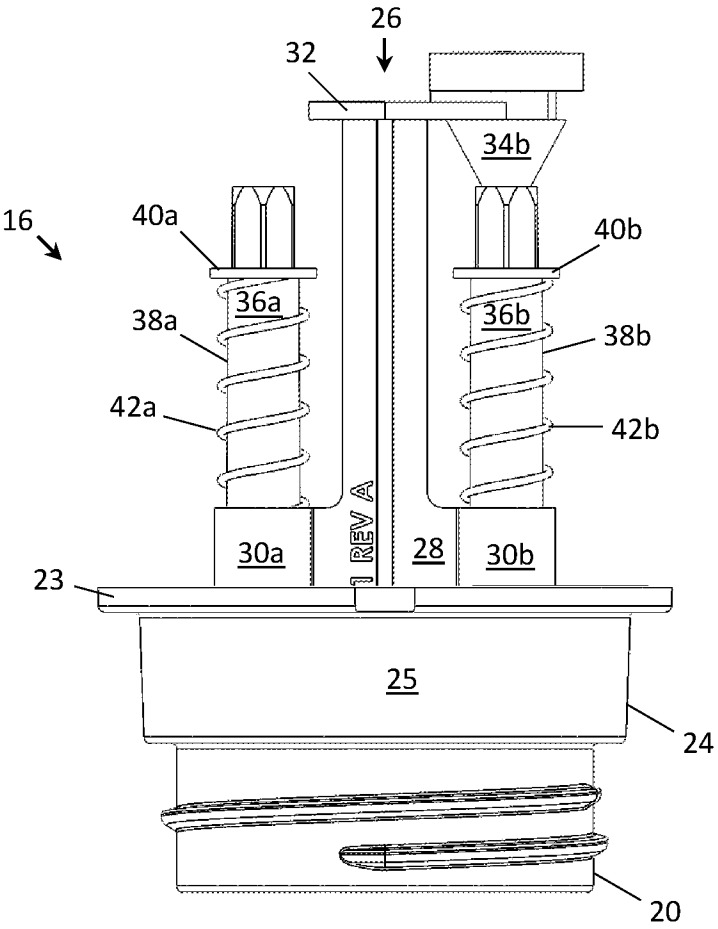
FIG. 2B depicts a side view of the dispensing cap, in accordance with one embodiment of the invention.
Figure 2A:
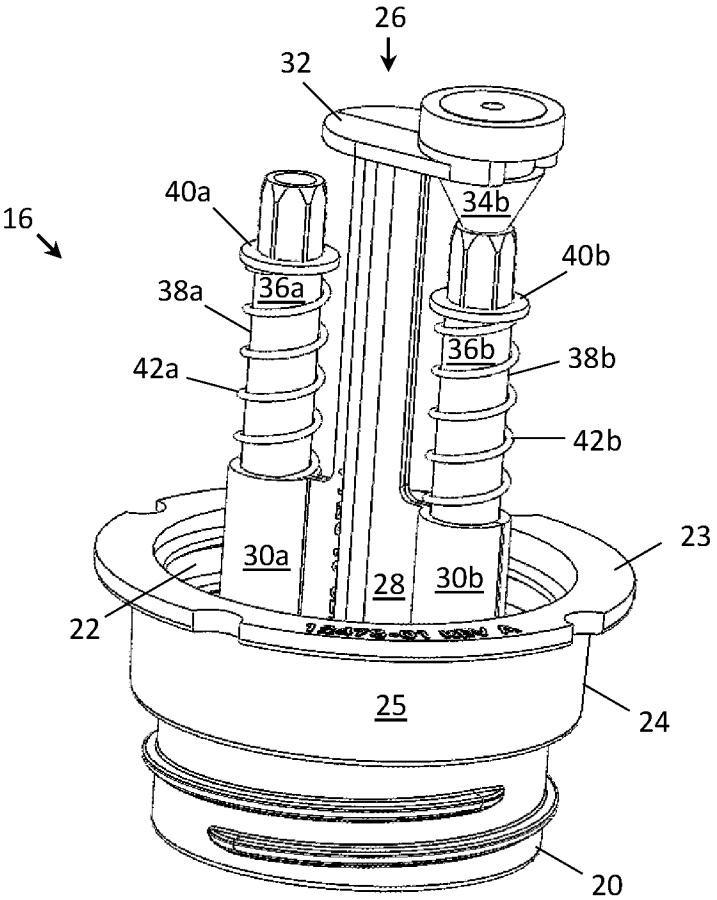
FIG. 2A depicts a perspective view of a dispensing cap, in accordance with one embodiment of the invention.
Figure 6C:
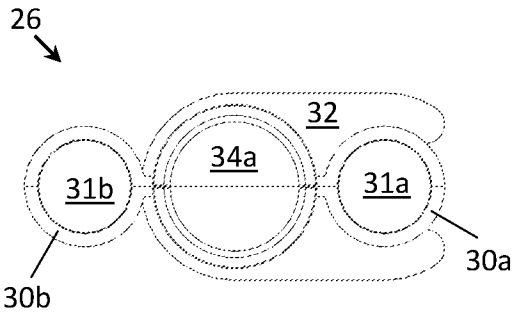
FIG. 6C depicts a bottom view of the sealing assembly, in accordance with one embodiment of the invention.

FIGS. 2A and 2B depict perspective and side views of the dispensing cap 16, respectively. The major components of the dispensing cap 16 may include a cap body 24 (see FIGS. 2F, 7A and 7B) and a sealing assembly 26 (see FIGS. 6A-6C). The cap body 24 may include a shell portion 25 and one or more guide rods 36*a*, 36*b*. The shell portion 25 may include the previously discussed threaded cylindrical outer surface 20 for attaching the dispensing cap 16 to the sealing cap 18. The shell portion 25 may also include a threaded cylindrical inner surface 22 for attaching the dispensing cap 16 to the threaded neck 58 (see FIG. 3B) of bottle 14. While the dispensing cap 16 may be secured to the bottle 14 via a threaded coupling, it is understood that other attachment means may be possible, such as a friction fit coupling, a bayonet mount, etc. The shell portion 25 may also include a projecting rim 23, the purpose of which will be better appreciated in the context of FIG. 3B.

Each of the guide rods 36*a*, 36*b* may include a guiding surface 38*a*, 38*b* for guiding the sealing assembly 26 from the default (sealed) position to the elevated (unsealed position). Such positions will be more fully explained in FIGS. 2D and 2E.

Figure 2C:
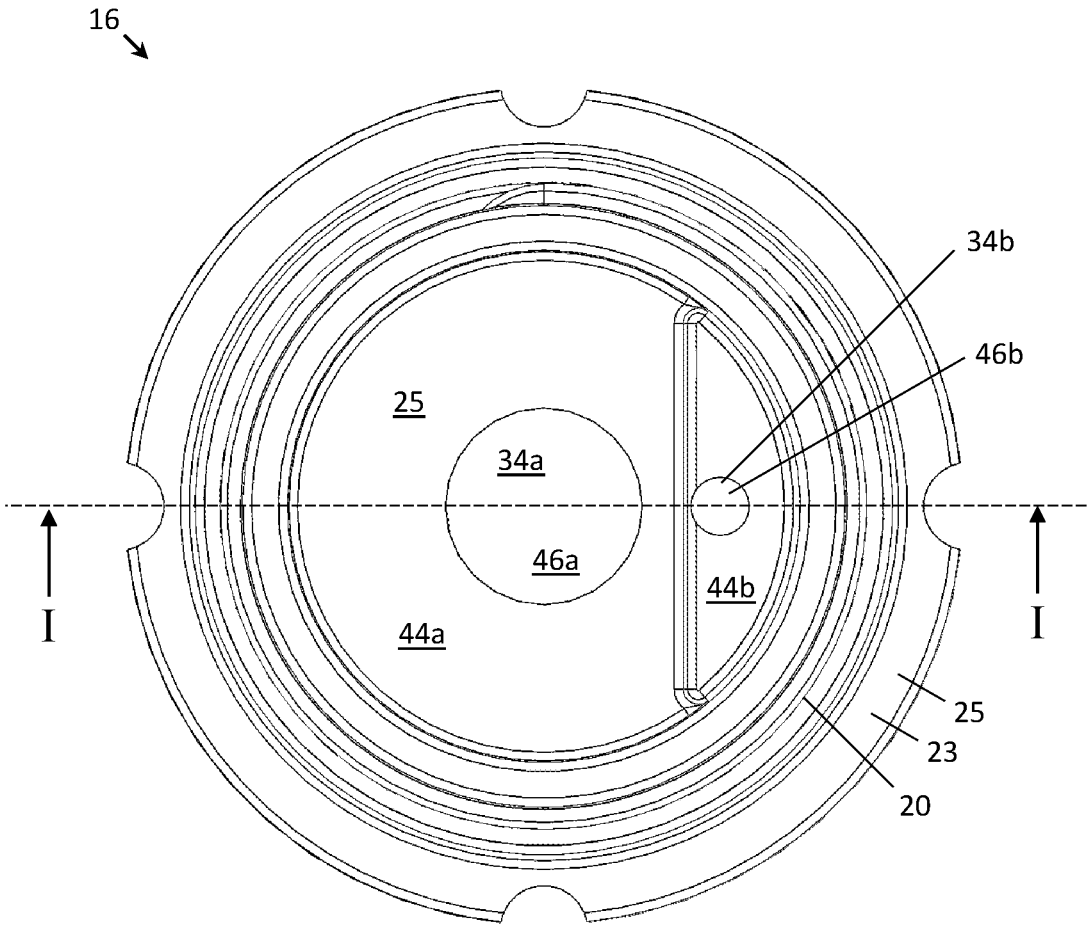
FIG. 2C depicts a bottom view of the dispensing cap, in accordance with one embodiment of the invention.

FIG. 2C depicts a bottom view of the dispensing cap 16, in which an opening 46*a* for dispensing a fluid (e.g., a liquid) from the bottle 14 and an opening 46*b* for passing a gas (e.g., air) into the bottle 14 are visible. Opening 46*b* may also be known as an air vent. As should be understood, when fluid is dispensed from the bottle 14, gas may be passed through the opening 46*b* to equalize the pressure within the bottle 14, thereby allowing additional fluid to be dispensed from the bottle 14. As shown in FIG. 2C, opening 46*a* may be distinct from opening 46*b*. Opening 46*a* may be present on surface 44*a* of the cap body 24, while opening 46*b* may be present on surface 44*b* of the cap body 24. As more clearly depicted in the cross-sectional views of FIGS. 2D and 2E, surface 44*b* may be offset from surface 44*a*. The reason for the offset will be better understood in the context of FIG. 5B. In the bottom view, stopper 34*a* may be visible within opening 46*a* and stopper 34*b* may be visible within opening 46*b*. The threaded cylindrical outer surface 20 (to which the sealing cap 18 attaches to) may encircle the surfaces 44*a*, 44*b*.

Figure 2E:
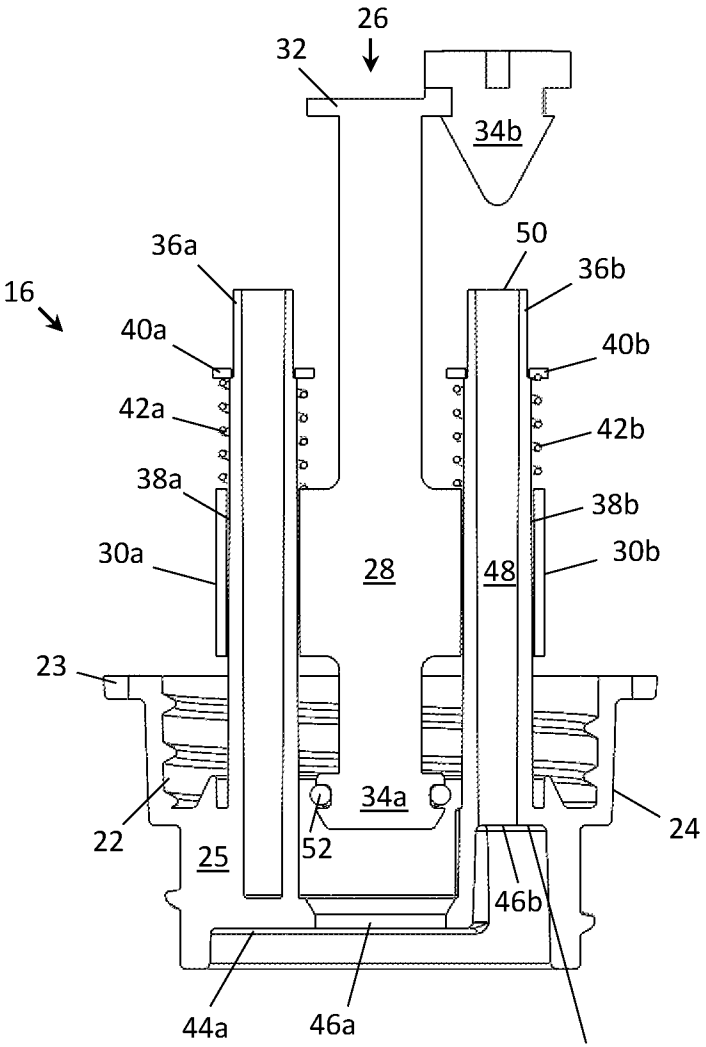
FIGS. 2D and 2E depict cross-sectional views of the dispensing cap along line I-I shown in FIG. 2C, in accordance with one embodiment of the invention.
Figure 2D:
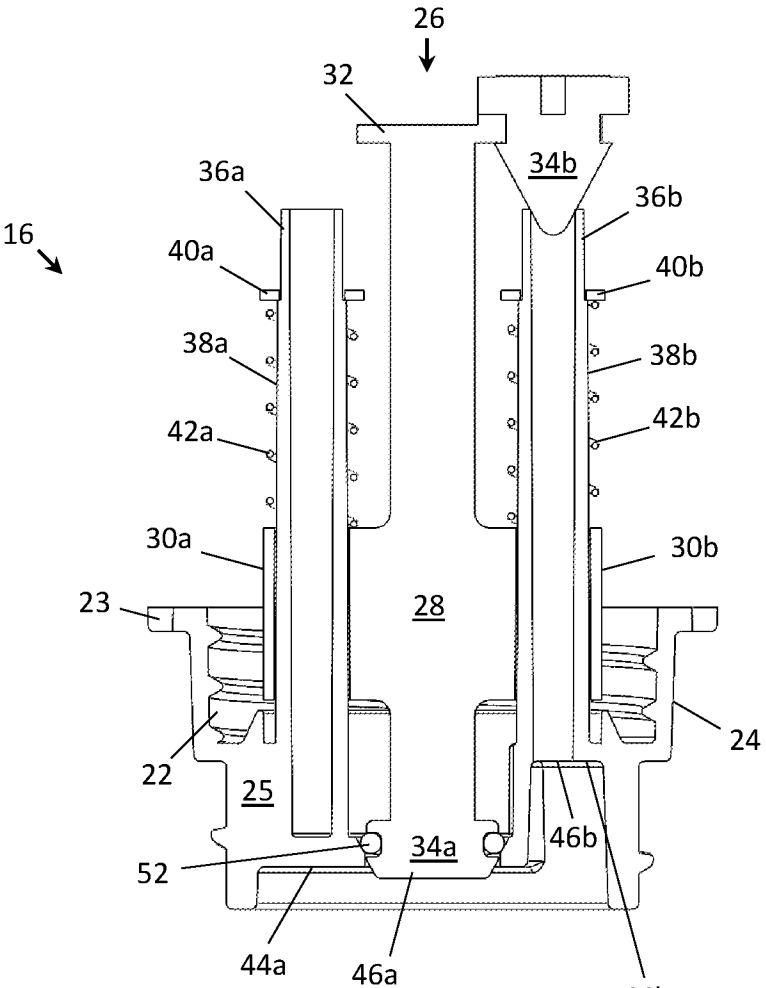

FIGS. 2D and 2E depict cross-sectional views of the dispensing cap along line I-I shown in FIG. 2C. In FIG. 2D, the sealing assembly 26 is disposed in the default (sealed) position, whereas in FIG. 2E, the sealing assembly 26 is disposed in the elevated (unsealed) position. As more completely shown in FIGS. 2D and 2E, the sealing assembly 26 may include a plunger 28 that is slidably attached to the one or more guiding surfaces 38*a*, 38*b* of the cap body 24. In one embodiment, the one or more guiding surfaces 38*a*, 38*b* may be formed by the surfaces of one or more guide rods 36*a*, 36*b* which are disposed parallel to an extent of the plunger 28. More specifically, the slidable attachment of the plunger 28 may be provided by ring member 30*a* of the sealing assembly 26 which is disposed around a circumference of guide rod 36*a*. The slidable attachment of the plunger 28 may also be provided by ring member 30*b* of the sealing assembly 26 which is disposed around a circumference of guide rod 36*b*. While the ring members 30*a*, 30*b* resemble cylinders in the depicted embodiments, it is noted that the ring members 30*a*, 30*b* need not fully encircle the circumference of the guide rods 36*a*, 36*b*. In such case, the ring members may be better referred to as guide members and more closely resemble a celery stalk (i.e., with a cross section that resembles a U-shape or a parenthesis ")").

A stopper 34*a*, affixed to one end of the plunger 28, may control a flow of fluid from the dispensing cap 16. In a first position (as shown in FIG. 2D), the stopper 34*a* may seal opening 46*a* preventing any fluid from flowing out of opening 46*a*. In a second position (as shown in FIG. 2E), the stopper 34*a* may be positioned away from opening 46*a* allowing fluid to flow out from opening 46*a*. To provide a better seal, stopper 34*a* may include a gasket 52 disposed within a groove about the circumference of the stopper 34*a*.

As shown in FIGS. 2D and 2E, the guide rod 36*b* may include an orifice 50 that is fluidly connected to a cavity 48 of the guide rod 36*b*, and the cavity 48 of the guide rod 36*b* may further be fluidly connected to the opening 46*b* of the cap body 24. A stopper 34*b*, affixed to another end of the plunger 28 via a stopper holder 32, may be used to control the flow of gas through the opening 46*b* of the cap body 24. In a first position (as shown in FIG. 2D), the stopper 34*b* may seal orifice 50 preventing any gas from flowing through opening 46*b*. In a second position (as shown in FIG. 2E), the stopper 34*b* may be positioned away from the orifice 50 allowing gas to flow through opening 46*b* (and into the bottle 14). The vertical distance between stopper 34*a* and stopper 34*b* may equal the vertical distance between the opening 46*a* and orifice 50, such that the sealing of the opening 46*a* and orifice 50 may occur simultaneously and the unsealing of the opening 46*a* and orifice 50 may occur simultaneously (i.e., in response to the displacement of the sealing assembly 26).

Plunger 28 may be biased toward opening 46*a* by one or more springs 42*a*, 42*b* which are coiled about the respective one or more guide rods 36*a*, 36*b*. That is, spring 42*a* may be coiled about guide rod 36*a* and spring 42*b* may be coiled about guide rod 36*b*. As shown in FIGS. 2D and 2E, a movement of the spring 42*a* may be constrained between a ridge 40*a* on a surface of the guide rod 36*a* and the ring member 30*a* of the sealing assembly 26. Similarly, a movement of the spring 42*b* may be constrained between a ridge 40*b* on a surface of the guide rod 36*b* and the ring member 30*b* of the sealing assembly 26. In one embodiment, the ridges 40*a*, 40*b* may be formed by washers 40*a*, 40*b* which are inserted about the respective circumferences of the guide rods 36*a*, 36*b*.

The position of the ridges 40*a*, 40*b* may be fixed on the respective guide rods 36*a*, 36*b*, so that the expansion of the springs 42*a*, 42*b* causes the ring members 30*a*, 30*b* to be translated downwards along the respective guide rods 36*a*, 36*b*, thereby biasing the sealing assembly 26 towards the opening 46*a*. In the reverse motion, a projecting portion 64 of a container receptacle 54 (see FIGS. 3C, 3D and 4) may be used to push the stopper 34*a* away from the opening 46*a*, causing ring members 30*a*, 30*b* to be translated upwards along the guide rods 36*a*, 36*b*, and further causing the spring 42*a* to become compressed between the ridge 40*a* and the ring member 30*a* and the spring 42*b* to become compressed between the ridge 40*b* and the ring member 30*b*.

The use of two (or more) guide rods 36*a*, 36*b* helps to balance the downward force imparted by the springs 42*a*, 42*b* on the plunger 28, allowing the ring members 30*a*, 30*b* to smoothly translate along the guide rods 36*a*, 36*b*, and centering the stopper 34*a* within opening 46*a*. In a less preferred embodiment, guide rod 36*a*, ring member 30*a*, spring 42*a*, and ridge 40*a* may be omitted, and the biasing of the sealing assembly 26 towards the opening 46*a* may be facilitated solely by guide rod 36*b*, ring member 30*b*, spring 42*b*, and ridge 40*b*. In this less preferred embodiment, the plunger 28 may pivot slightly about its attachment region to the guide rod 36*a*, potentially causing more friction to occur between the ring member 30*b* and the guiding surface 38*b* and causing a slight misalignment between the stopper 34*a* and opening 46*a*. However, such an embodiment (even if less preferable) may still provide the desired operation of the dispensing cap 16.

Figure 2F:
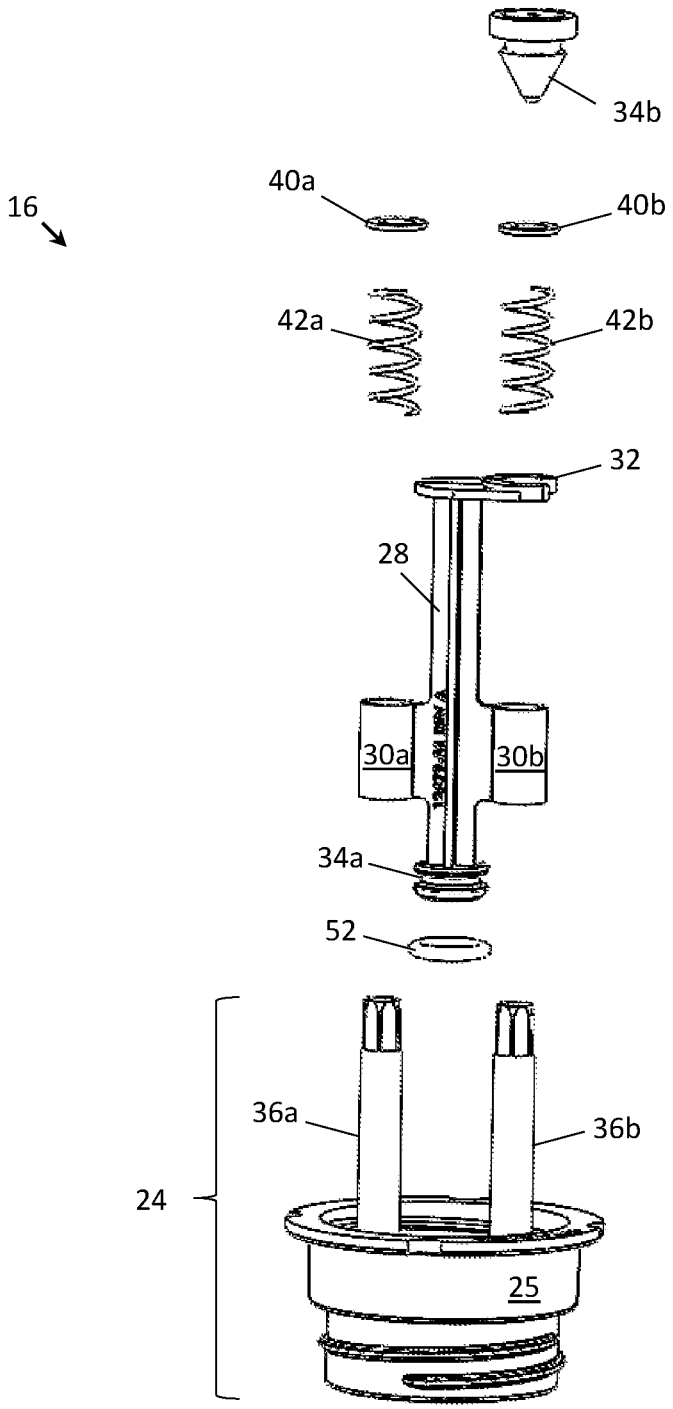
FIG. 2F depicts an exploded perspective view of the dispensing cap, in accordance with one embodiment of the invention.

FIG. 2F depicts an exploded perspective view of the dispensing cap 16. To assemble the dispensing cap 16, the gasket 52 may be first secured within a groove of the stopper 34*a*. Then, the guide rod 36*a* may be inserted through ring member 30*a*, spring 42*a*, and washer 40*a*. Similarly, the guide rod 36*b* may be inserted through ring member 30*b*, spring 42*b*, and washer 40*b*. The guide rods 36*a*, 36*b* may be slightly tapered, such that the washers 40*a*, 40*b* may initially slide freely along the guide rods 36*a*, 36*b* before becoming fixed in place along the guide rods 36*a*, 36*b* due to friction between the contacting surfaces between the washers 40*a*, 40*b* and the guide rods 36*a*, 36*b*. Finally, the stopper 34*b* may be secured to the stopper holder 32. As should be apparent, the lateral spacing between the two ring members 30*a*, 30*b* should match the lateral spacing between the two guide rods 36*a*, 36*b*.

Figure 3A:
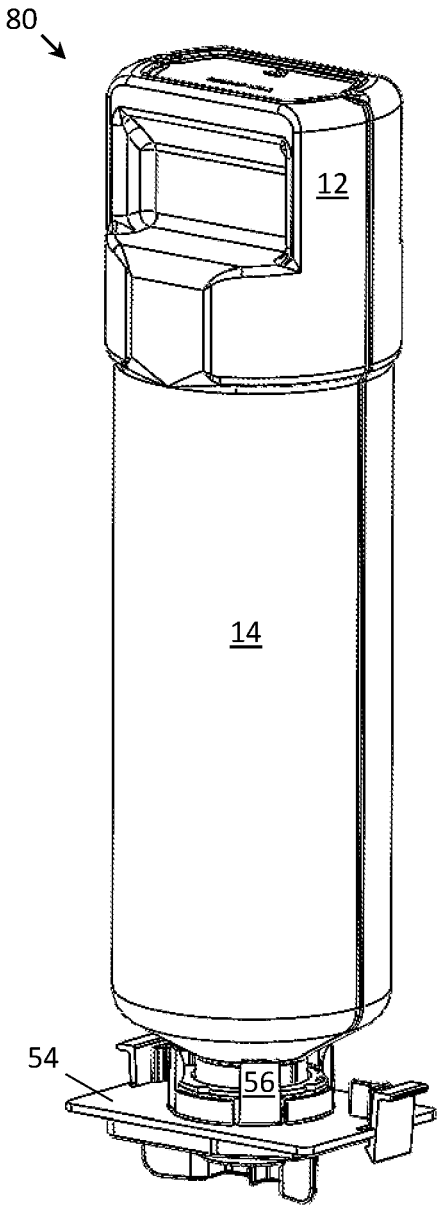
FIG. 3A depicts a perspective view a fluid dispensing system including a fluid container that has been secured to a container receptacle, in accordance with one embodiment of the invention.

FIG. 3A depicts a perspective view of a fluid dispensing system 80 formed by a the fluid container 10 and a container receptacle 54, after the fluid container 10 has been secured to the container receptacle 54. Tabs 56 of the container receptacle 54 may be disposed about a circumference of the dispensing cap 16 for securing the fluid container 10 to the container receptacle 54. While four tabs 56 are present in the example container receptacle 54 depicted in FIGS. 3A and 3B, it is understood that one or more tabs 56 may be present in other embodiments.

Figure 3B:
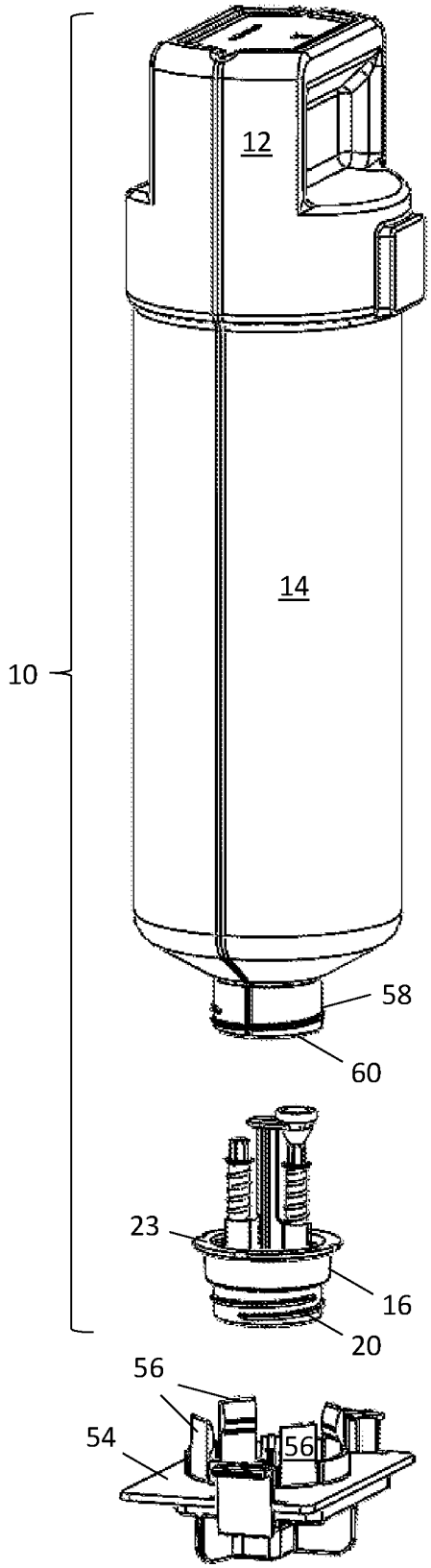
FIG. 3B depicts an exploded perspective view of the fluid dispensing system depicted in FIG. 3A, in accordance with one embodiment of the invention.

FIG. 3B depicts an exploded perspective view of the fluid dispensing system 80, in which the bottle 14, the dispensing cap 16 and the container receptacle 54 are shown separately from one another. To assemble the components, the dispensing cap 16 may first be inserted through the opening 60 of the bottle 14. Next, the dispensing cap 16 may be secured to the bottle 14 by securing the threaded cylindrical inner surface 22 of the dispensing cap 16 to the threaded neck 58 of the bottle 14 (e.g., by a screwing motion). The fluid container 10 (including the bottle 14 and dispensing cap 16) may be oriented such that the opening 60 of the bottle 14 is pointed towards the container receptacle 54. Finally, the fluid container 10 may be inserted into the container receptacle 54, until tabs 56 of the container receptacle 54 latch onto a projecting rim 23 of the dispensing cap 16. It is understood that while tabs 56 and the projecting rim 23 may be used to secure the fluid container 10 to the container receptacle 54, other securing mechanisms may be employed, such as a threaded coupling, a friction fit coupling, a bayonet mount, etc. For clarity, it is noted that the threaded cylindrical outer surface 20 (for securing the dispensing cap 16 to the sealing cap 18) may not serve any purpose when the fluid container 10 is secured to the container receptacle 54.

Figure 3C:
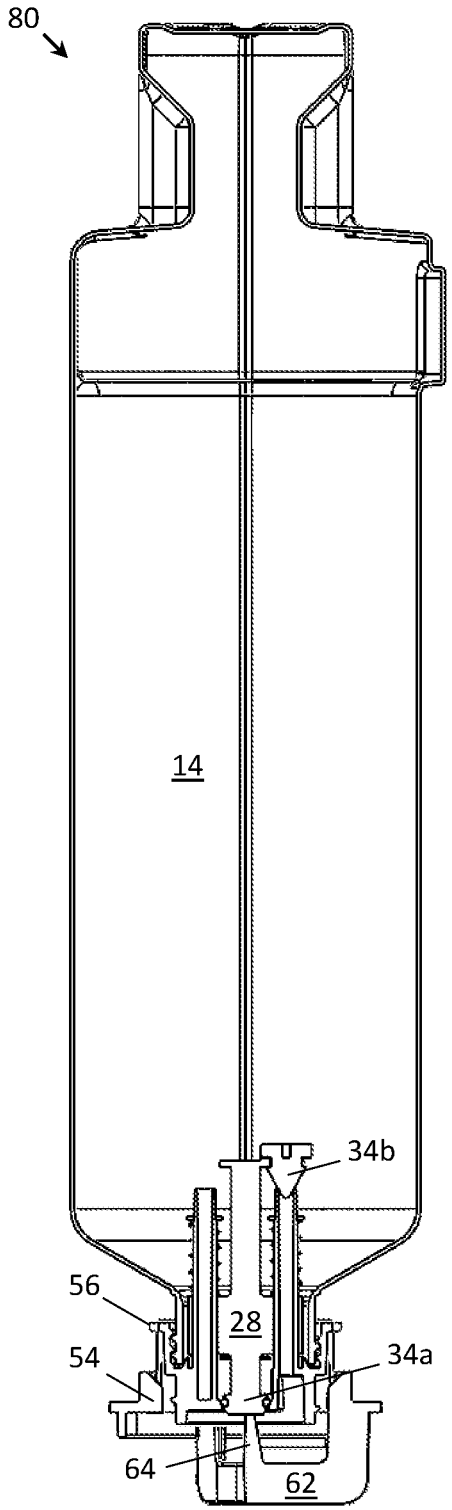
FIG. 3C depicts a cross-sectional view of the fluid dispensing system immediately before a projecting portion of the container receptacle displaces the sealing assembly of the dispensing cap into the elevated position, in accordance with one embodiment of the invention.

FIG. 3C depicts a cross-sectional view of the fluid dispensing system 80 immediately before a projecting portion 64 of the container receptacle 54 displaces the sealing assembly 26 of the dispensing cap 16 into an elevated position. In the view of FIG. 3C, opening 46*a* of the cap body 24 and orifice 50 of the guide rod 36*b* are sealed by stopper 34*a* and stopper 34*b*, respectively, preventing any fluid from being dispensed from bottle 14 or gas from flowing into the bottle 14. Further, the projecting rim 23 of the cap body 24 has yet to engage with the tabs 56 of the container receptacle 54.

Figure 3D:
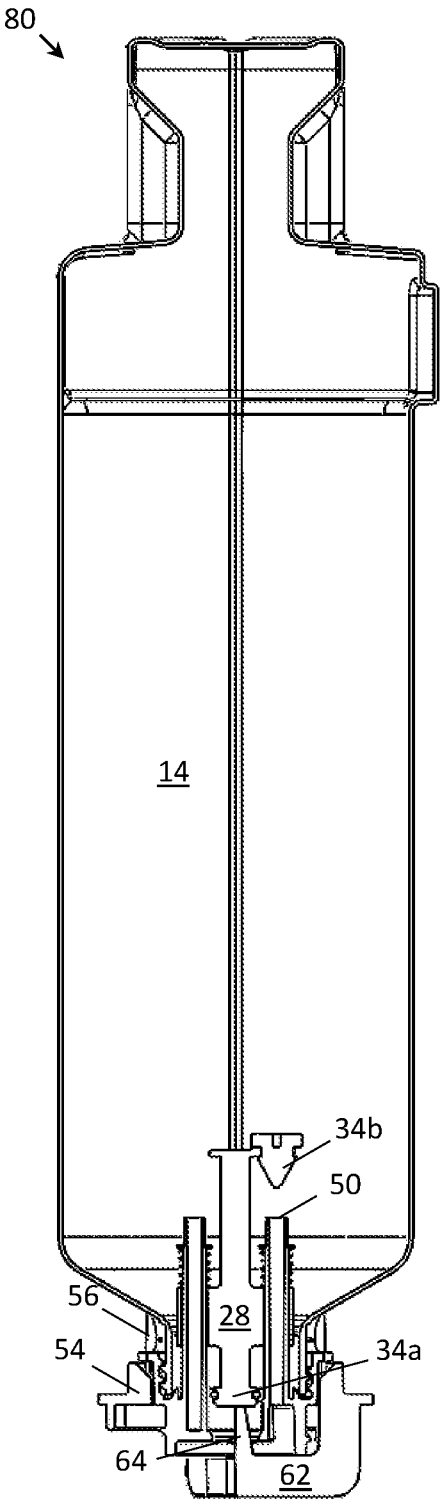
FIG. 3D depicts a cross-sectional view of the fluid dispensing system after the projecting portion of the container receptacle has displaced the sealing assembly of the dispensing cap into the elevated position, in accordance with one embodiment of the invention.

FIG. 3D depicts a cross-sectional view of the fluid dispensing system 80 after the projecting portion 64 of the container receptacle 54 has displaced the sealing assembly 26 of the dispensing cap 16 into an elevated position. Due to this displacement, the opening 46*a* of the cap body 24 and orifice 50 of the guide rod 36*b* are unsealed, allowing fluid to flow from the bottle 14 through the opening 46*a* and gas to flow into the bottle 14 through the opening 46*b*. In the view of FIG. 3D, tabs 56 of the container receptacle 54 have latched onto the projecting rim 23 of the dispensing cap 16.

Figure 4:
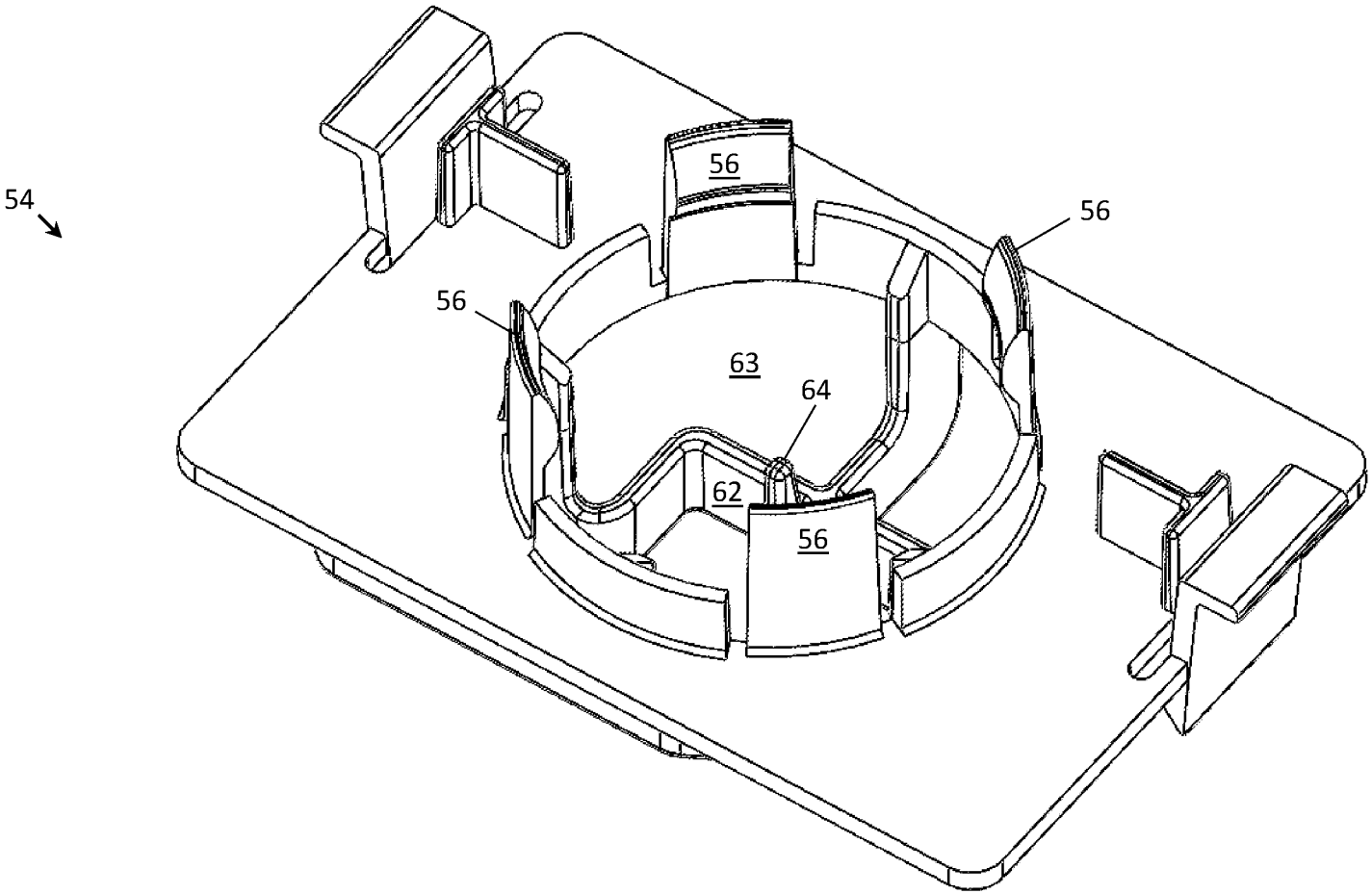
FIG. 4 depicts an enlarged perspective view of the container receptacle, in accordance with one embodiment of the invention.

FIG. 4 depicts a magnified view of the container receptacle 54, showing the four tabs 56 and projecting portion 64 in greater detail. As shown in FIGS. 3A, 3B and 4, projecting portion 64 may project from a base portion 62 of the container receptacle 54. The base portion 62 includes one or more openings 63, allowing fluid from the bottle 14 to flow through the container receptacle 54 into a tank 66 (see FIGS. 5A and 5B) located below the container receptacle 54.

Figure 5A:
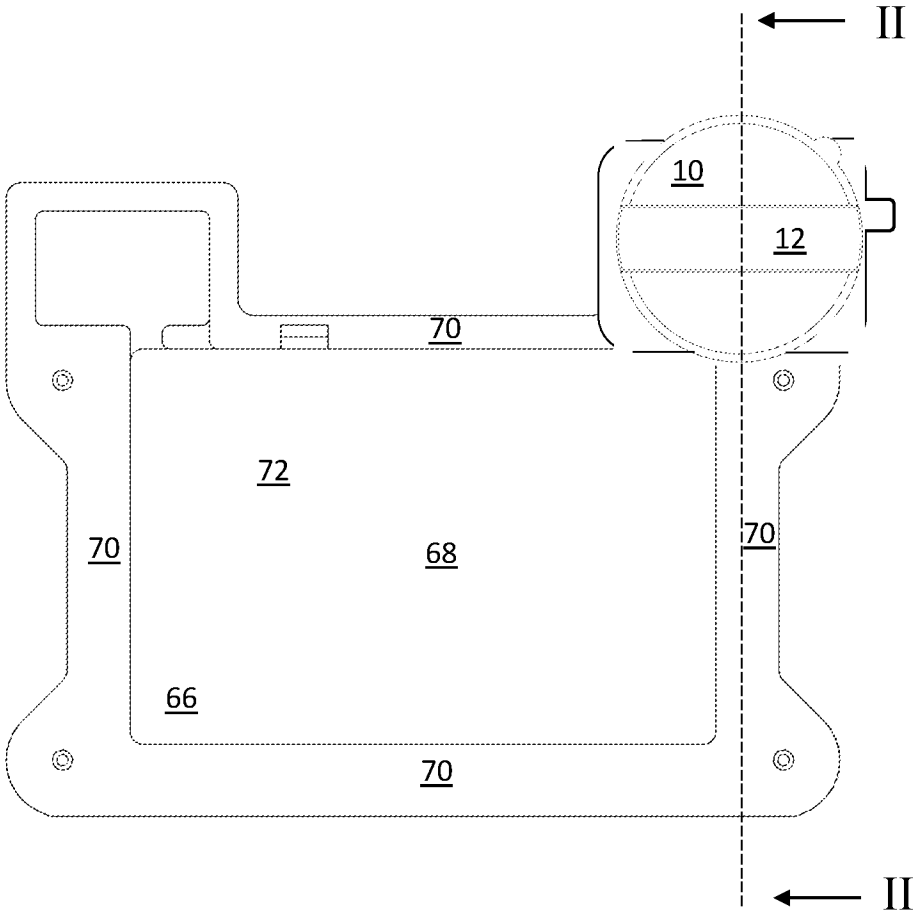
FIG. 5A depicts a top view of a fluid dispensing system coupled to a tank of a 3D printing system, in accordance with one embodiment of the invention.

FIG. 5A depicts a top view of the fluid dispensing system 80 fluidly coupled to a tank 66 of a 3D printing system. The tank 66 may be used to contain the fluid 72 dispensed from the fluid container 10. The sides of the tank 66 may be formed by tank sidewalls 70, and the bottom of the tank 66 may be formed by a radiation-transparent flexible membrane 68 that allows radiation from a light source (not depicted) below the tank 66 to enter into the tank 66. Additional details of the light source of the 3D printing system may also be found in U.S. Pat. No. 11,498,275.

Figure 5B:
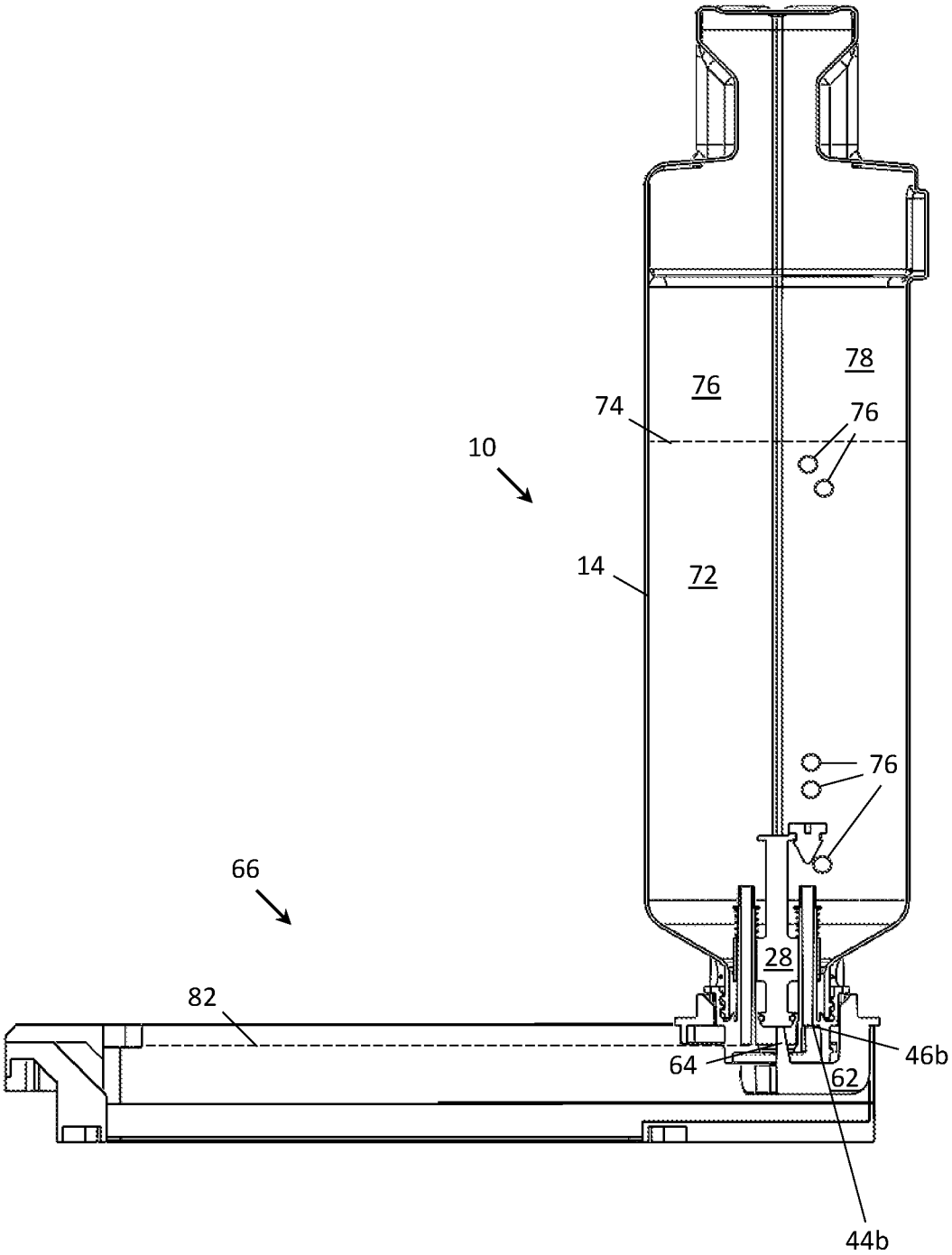
FIG. 5B depicts a cross-sectional view along line II-II shown in FIG. 5A, in accordance with one embodiment of the invention.

FIG. 5B depicts a cross-sectional view along line II-II shown in FIG. 5A. In the view of FIG. 5B, the sealing assembly 26 is displaced by the projecting portion 64, allowing fluid 72 to flow out of the opening 46*a* into the tank 66 and gas 76 (e.g., ambient air) to flow through the opening 46*b* and into the cavity 78. The flow of fluid 72 from the fluid container 10 may create a partial vacuum within the fluid container 10 (i.e., in the portion of the cavity 78 occupied by the gas 76) which partially impedes the flow of additional fluid 72 from the fluid container 10 into the tank 66. Fluid level 74 represents the top level of the fluid 72 within the cavity 78. Intermittently, gas 76 (e.g., shown as gas bubbles within the fluid 72) may flow into the fluid container 10 through opening 46*b*, reducing the partial vacuum within the fluid container 10 and allowing additional fluid 72 to flow into the tank 66. Eventually, when the fluid 72 reaches a fill line 82 of the tank 66, an equilibrium may be reached between the forces exerted on the fluid 72 within the tank 66 and the forces exerted on the fluid 72 within the fluid container 10, causing the fluid 72 to stop flowing from the fluid container 10. As the fluid 72 is consumed within the tank 66 by printing operations, the top surface of the fluid 72 within the tank 66 may intermittently decrease below the fill line 82, causing additional fluid 72 from the fluid container 10 to flow into the tank 66 until the fluid 72 reaches the fill line 82 again. For clarity, it is noted that the fill line 82 is meant to represent a fixed vertical elevation which approximately corresponds to the maximum fluid level of the fluid 72 within the tank 66.

The surface 44*b* in which the opening 46*b* is present may be elevated above the fill line 82 in order to configure opening 46*b* as the air vent. If opening 46*a* and 46*b* were present at the same vertical elevation, gas and fluid may pass through each of the openings 46*a* and 46*b*, which is less desirable as the flow of fluid from the dispensing cap 16 may become more irregular (e.g., a large flow of fluid may be followed by a slow trickle).

Figure 6B:
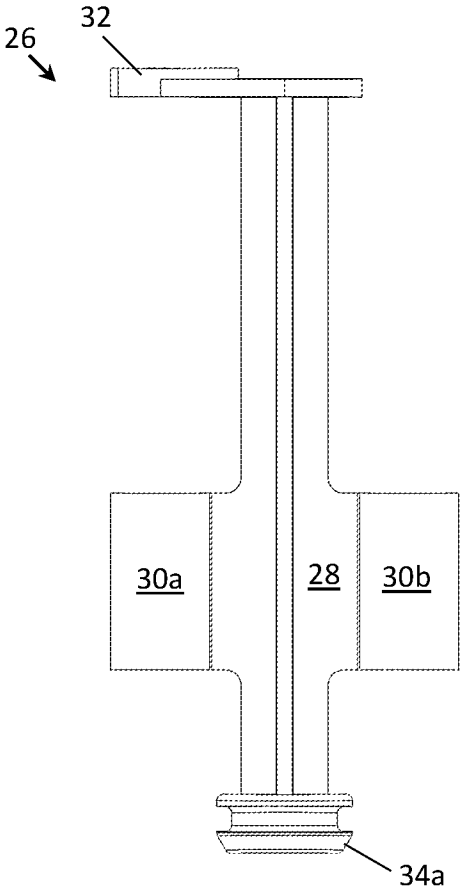
FIG. 6B depicts a side view of the sealing assembly, in accordance with one embodiment of the invention.
Figure 6A:
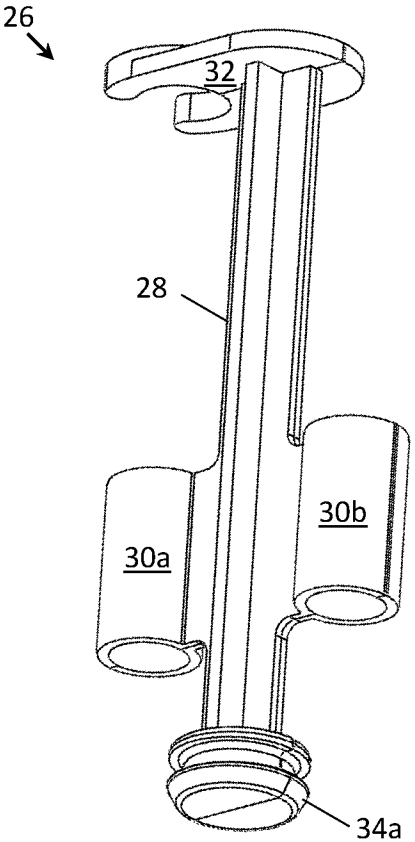
FIG. 6A depicts a perspective view of the sealing assembly, in accordance with one embodiment of the invention.

FIGS. 6A and 6B depict perspective and side views of the sealing assembly 26, respectively, which may include plunger 28, ring members 30*a*, 30*b*, stopper holder 32, stopper 34*a* and stopper 34*b* (not depicted). Stopper 34*a* may be affixed to one end of the plunger 28, while stopper holder 32 may be affixed to the other end of the plunger 28. Ring members 30*a*, 30*b* may be affixed to opposing sides of the plunger 28. Stopper 34*b* (not depicted) may be secured to the stopper holder 32. The respective cavities 31*a*, 31*b* of the ring members 30*a*, 30*b* are visible in the bottom view depicted in FIG. 6C.

Figure 7B:
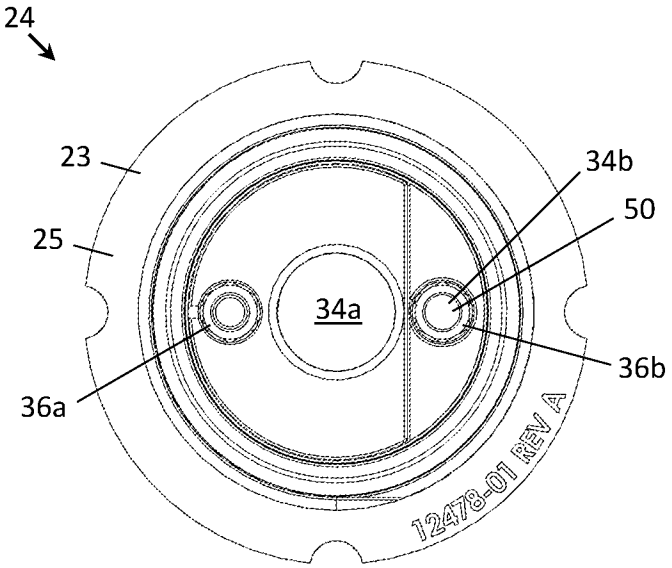
FIG. 7B depicts a top view of the cap body, in accordance with one embodiment of the invention.
Figure 7A:
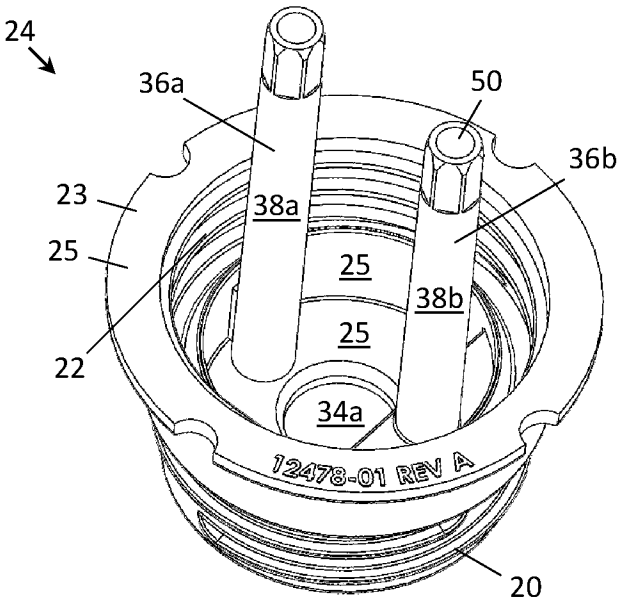
FIG. 7A depicts a perspective view of a cap body, in accordance with one embodiment of the invention.

FIGS. 7A and 7B depict perspective and top views of the cap body 24, respectively, which may include a shell portion 25 and one or more guide rods 36*a*, 36*b* affixed to the shell portion 25. Whereas the guiding surfaces 38*a*, 38*b* may have been obscured in the previous views by the ring members 30*a*, 30*b* and/or springs 42*a*, 42*b*, the guiding surfaces 38*a*, 38*b* are clearly visible in the perspective view of FIG. 7A. The orifice 50 of the guide rod 36*b* and openings 34*a*, 34*b* of the cap body 24 are visible in the top view of FIG. 7B. For clarity, it is noted that the orifice 50 of the guide rod 36*b* and the opening 34*b* of the cap body 24 are aligned with one another in the top view of FIG. 7B. While not previously discussed, it is further noted that guide rod 36*a* may similarly include a cavity (corresponding to cavity 48 of guide rod 36*b*) and an orifice (corresponding to orifice 50 of guide rod 36*b*). However, the cavity and orifice of guide rod 36*a* may not serve any functional purpose, so in another embodiment, guide rod 36*a* could be constructed as a solid rod without any cavity or orifice.

Thus, a system and method for dispensing a fluid have been described. It is to be understood that the above-description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

LIST OF REFERENCE NUMERALS

10 Fluid container
12 Handle of fluid container
14 Bottle
16 Dispensing cap
18 Sealing cap
20 Threaded cylindrical outer surface
22 Threaded cylindrical inner surface
23 Projecting rim
24 Cap body
25 Shell portion
26 Sealing assembly
28 Plunger
30*a*, 30*b* Ring members
31*a*, 31*b* Cavities of ring members
32 Stopper holder
34*a*, 34*b* Stoppers
36*a*, 36*b* Guide rods
38*a*, 38*b* Guiding surfaces
40*a*, 40*b* Ridge, washers
42*a*, 42*b* Springs
44*a*, 44*b* Surfaces of the cap body
46*a*, 46*b* Openings of cap body
48 Cavity of guide rod
50 Orifice
52 Gasket
54 Container receptacle
56 Tabs
58 Threaded neck of bottle
60 Opening of bottle
62 Base portion
63 Opening of base portion
64 Projecting portion
66 Tank
68 Membrane
70 Tank sidewall
72 Fluid
74 Fluid level

76 Gas
78 Cavity of fluid container
80 Fluid dispensing system
82 Fill line

What is claimed is:

1. A dispensing cap, comprising:

a cap body with a first opening, a second opening distinct from the first opening, and one or more guiding surfaces, the first opening for dispensing a fluid, and the second opening for passing a gas;

a sealing assembly slidably attached to the one or more guiding surfaces of the cap body and translatable between a first position and a second position, wherein in the first position, the sealing assembly seals the first opening and stops a flow of the gas through the second opening, and wherein in the second position, the sealing assembly does not seal the first opening and does not stop the flow of the gas through the second opening;

wherein the sealing assembly comprises:

a plunger;

a first stopper affixed to the plunger, wherein in the first position of the sealing assembly, the first stopper is configured to seal the first opening of the cap body; and, wherein the one or more guiding surfaces are formed by a first guide rod disposed parallel to an extent of the plunger; and, wherein the sealing assembly comprises a ring member, and wherein the first guide rod is inserted through the ring member of the sealing assembly.

2. The dispensing cap of claim 1, wherein the first guide rod comprises an orifice that is fluidly connected to a cavity of the first guide rod, and wherein the cavity of the first guide rod is fluidly connected to the second opening of the cap body.

3. The dispensing cap of claim 2, wherein the sealing assembly further comprises a second stopper affixed to the plunger, and wherein in the first position of the sealing assembly, the second stopper is configured to seal the orifice of the first guide rod.

4. The dispensing cap of claim 1, further comprising a first spring coiled about the first guide rod, the first spring configured to bias the plunger towards the first opening of the cap body.

5. The dispensing cap of claim 1, wherein a movement of a first spring is constrained between a ridge on a surface of the first guide rod and the ring member of the plunger.

6. The dispensing cap of claim 1, wherein the one or more guiding surfaces are formed by a second guide rod disposed parallel to the extent of the plunger.

7. The dispensing cap of claim 6, wherein a movement of the second spring is constrained between a ridge on a surface of the second guide rod and the ring member of the plunger.

8. The dispensing cap of claim 1, wherein the first opening of the cap body is disposed on a first surface of the cap body and the second opening of the cap body is disposed on a second surface of the cap body that is offset from the first surface.

9. A fluid dispensing system, comprising:

a fluid container formed by (i) a bottle and (ii) the dispensing cap of claim 1 secured to an opening of the bottle; and a container receptacle comprising a projecting member that protrudes from a base portion of the container receptacle, the projecting member for displacing the sealing assembly of the dispensing cap from the first position to the second position, wherein the fluid container is secured to the container receptacle.

10. The fluid dispensing system of claim 9, wherein the container receptacle further comprises a plurality of tabs disposed about a circumference of the dispensing cap for securing the fluid container to the container receptacle.

11. A dispensing cap, comprising:

a cap body with a first opening, a second opening distinct from the first opening, and one or more guiding surfaces, the first opening for dispensing a fluid, and the second opening for passing a gas;

a sealing assembly slidably attached to the one or more guiding surfaces of the cap body and translatable between a first position and a second position, wherein in the first position, the sealing assembly seals the first opening and stops a flow of the gas through the second opening, and wherein in the second position, the sealing assembly does not seal the first opening and does not stop the flow of the gas through the second opening;

wherein the sealing assembly comprises:

a plunger;

a first stopper affixed to the plunger, wherein in the first position of the sealing assembly, the first stopper is configured to seal the first opening of the cap body; and, wherein the one or more guiding surfaces are formed by a first guide rod disposed parallel to an extent of the plunger;

wherein the one or more guiding surfaces are formed by a second guide rod disposed parallel to the extent of the plunger; and, a second spring coiled about the second guide rod, the second spring configured to bias the plunger towards the first opening of the cap body.

12. A dispensing cap, comprising:

a cap body with a first opening, a second opening distinct from the first opening, and one or more guiding surfaces, the first opening for dispensing a fluid, and the second opening for passing a gas;

a sealing assembly slidably attached to the one or more guiding surfaces of the cap body and translatable between a first position and a second position, wherein in the first position, the sealing assembly seals the first opening and stops a flow of the gas through the second opening, and wherein in the second position, the sealing assembly does not seal the first opening and does not stop the flow of the gas through the second opening;

wherein the sealing assembly comprises:

a plunger;

a first stopper affixed to the plunger, wherein in the first position of the sealing assembly, the first stopper is configured to seal the first opening of the cap body; and, wherein the one or more guiding surfaces are formed by a first guide rod disposed parallel to an extent of the plunger;

wherein the one or more guiding surfaces are formed by a second guide rod disposed parallel to the extent of the plunger; and, wherein the sealing assembly comprises a ring member, and wherein the second guide rod is inserted through the ring member of the sealing assembly.

* * * * *